US005983908A

United States Patent [19]

Bradley

[11] Patent Number: 5,983,908

[45] Date of Patent: Nov. 16, 1999

[54] GLASS WASHING AND DISHWASHING MACHINE

[76] Inventor: Carl L. Bradley, 25636 SE. Tiger Mountain Rd., Issaquah, Wash. 98027

[21] Appl. No.: 09/095,666

[22] Filed: Jun. 10, 1998

[51] Int. Cl.[6] ..... B08B 3/02

[52] U.S. Cl. ..... 134/57 D; 134/58 D; 134/83; 134/186; 134/201

[58] Field of Search ..... 134/56 D, 57 D, 134/58 D, 68, 72, 104.2, 82, 83, 186, 201

[56] References Cited

U.S. PATENT DOCUMENTS

| | | | |
|---|---|---|---|
| 2,746,466 | 5/1956 | Clague et al. | 134/60 |
| 2,949,120 | 8/1960 | Federighi et al. | 134/60 |
| 3,217,721 | 11/1965 | Hertel | 134/60 |
| 3,856,572 | 12/1974 | Hilderbrand | 134/131 |
| 3,884,263 | 5/1975 | Wright . | |
| 4,280,520 | 7/1981 | Fraula et al. | 134/60 |
| 5,247,953 | 9/1993 | D'Amoto | 134/186 |
| 5,374,352 | 12/1994 | Pattee | 134/111 |

FOREIGN PATENT DOCUMENTS

| | | | |
|---|---|---|---|
| 564155 | 11/1932 | Germany | 134/183 |

*Primary Examiner*—Frankie L. Stinson
*Attorney, Agent, or Firm*—Thomas I. Rozsa; Tony D. Chen; Jerry Fong

[57] ABSTRACT

A glass washing and dishwashing machine including an improved oscillating spray mechanism, an improved tank valve/water diversion mechanism, and an improved water tank assembly, which are all incorporated into the glass washing and dishwashing machine. The oscillating spray mechanism directs a spray of wash water or rinse water at glasses, dishes or the like and oscillates the spray mechanism in order to more completely contact glasses or the like with wash water during a washing and rinsing operation. The tank valve mechanism selectively supplies wash water or rinse water from the tank assembly to the spray mechanism. The valve/water diversion mechanism is interconnected with two water reservoir chambers for delivering wash or rinse water to a washing station.

16 Claims, 8 Drawing Sheets

FIG.10
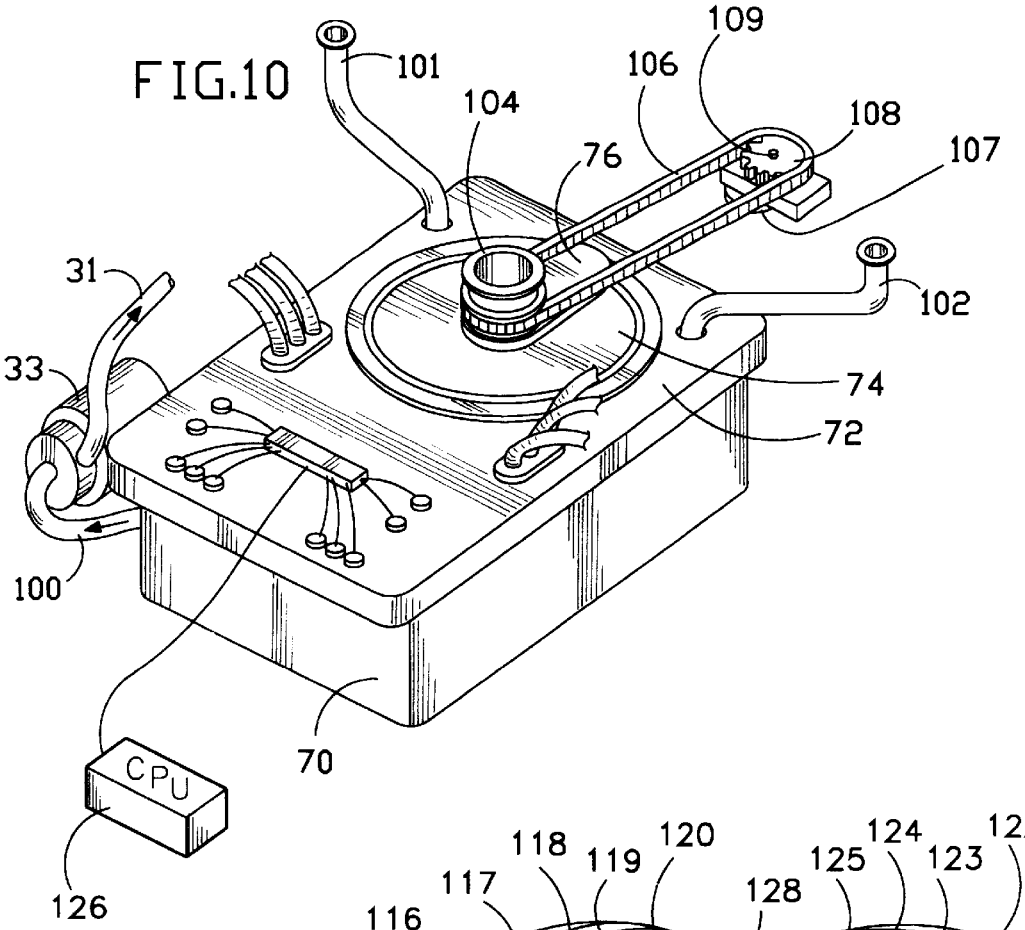
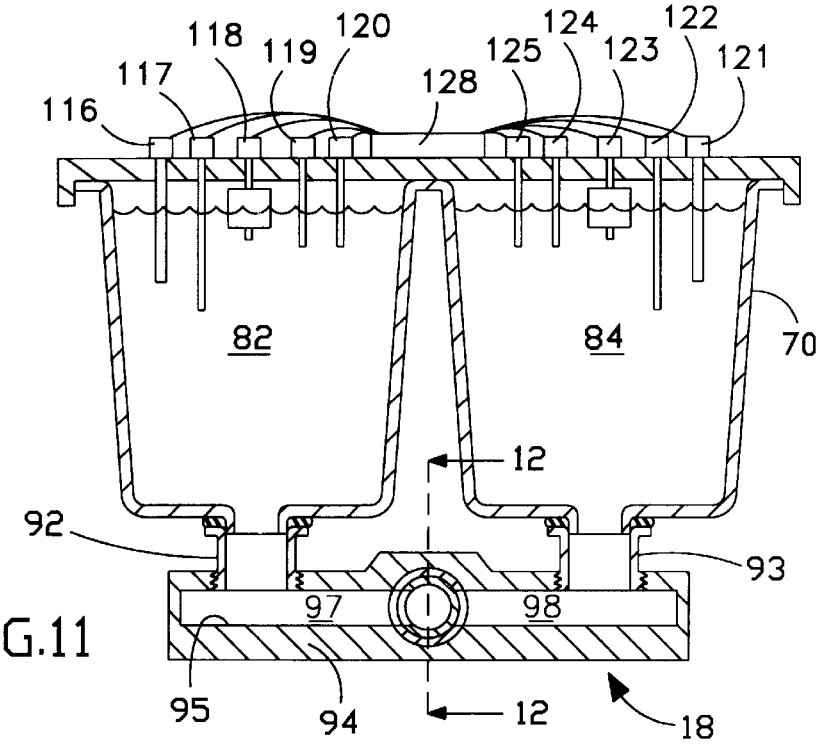
FIG.11

GLASS WASHING AND DISHWASHING MACHINE

BACKGROUND OF THE INVENTION

1. Field of the Invention

The present invention generally relates to the field of machines for washing glassware and dishware. More particularly, the present invention relates to the field of glass washing and dishwashing machines for automatically washing glasses and dishware.

2. Description of the Prior Art

Generally, glass washing machines and dishwashing machines are well known in the art. One type of glass washing and dishwashing machine is disclosed in U.S. Pat. No. 3,884,263 issued to Wright on May 20, 1975 for "Dishwashing Machine" (hereafter the "'263 patent"). The '263 patent discloses a dishwashing machine which comprises a dish loading zone, a washing zone and an unloading zone. The washing zone is enclosed by a structure containing ingress and egress openings on both sides for transferring dishes into and out of the washing zone. The loading and unloading zones flank either side of the washing zone and contain transport racks for moving dishes in and out of the washing zone. A wash rack in the washing zone functions to receive the dishes from either of the transport racks and to hold the dishes during the wash cycles. The wash rack transfers the dishes back to either of the transport racks for removal from the washing zone. An oscillating spray apparatus is mounted in the washing zone. Two opposing manifolds are mounted in both the upper and lower portions of the washing zone. The manifolds support oscillatable spray bars which are releasably secured in the manifolds. Water holding tanks for wash and rinse water are located below the washing zone. A rotary valve is connected to the holding tanks to selectively supply wash or rinse water to the spray apparatus through a water pump. A drain conduit and movable diverter mechanism is connected thereto, which can selectively direct water from the washing zone to one of the wash water holding tank, the rinse water holding tank or a drain tank.

The inventor and applicant of the present invention has sought to further improve the capabilities of the glass washing machine and dishwashing machine of the type disclosed in the '263 patent for automatically washing and sterilizing glasses in commercial installations such as restaurants or like industry. Therefore, it is highly desirable to have a very efficient and also very effective design and construction of an improved glass washing and dishwashing machine for automatically washing and sterilizing glasses for restaurants or like industry. It is desirable to provide an improved glass washing machine and dishwashing machine with an improved oscillating spray mechanism located within the washing zone. It is also desirable to provide an improved glass washing and dishwashing machine with an improved tank valve mechanism for selectively supplying wash water or rinse water to the spray mechanism from one of either the wash water reservoir chamber or the rinse water reservoir tank.

SUMMARY OF THE INVENTION

The present invention and innovations therein provide for an improved oscillating spray mechanism that is also more versatile in functionality/adaptability. This incorporates an improved tank valve/water diversion mechanism, an improved sink water diverter/tank lid integrated design, and an improved water tank design utilizing a sealed top/lid, and a safer more efficiently controlled environment with improved electronics, and all are incorporated into a commercial type of glass washing and dishwashing machine.

It is an object of the present invention to provide an improved glass washing and dishwashing machine which has a loading zone, an unloading zone, and a washing zone for selectively transporting glasses and the like between two or more of the zones.

It is also an object of the present invention to provide an improved glass washing and dishwashing machine for storing, recycling and replenishing the wash and rinse water used in the washing machine to provide improved means for draining water from the washing and rinsing stations during operation, to provide means for conserving energy and water used by the machine, and to provide improved means for holding the wash and rinse water in the machine and recycling it for use in the washing and rinsing operation.

It is an additional object of the present invention to provide an improved glass and dishwashing machine which has an improved oscillating spray mechanism for directing a spray of wash water or rinse water at glasses, dishes or the like and oscillating the spray mechanism in order to more completely contact glasses, dishes or the like with water during a washing and rinsing operation, and to provide such a mechanism which can be easily dismantled for cleaning or repair.

It is a further object of the present invention to provide an improved glass washing and dishwashing machine which has an improved tank valve/water diversion mechanism for selectively supplying wash water or rinse water to the spray mechanism. The tank valve/water diversion mechanism is interconnected with an improved water tank having two water reservoir chambers for delivering wash water and rinse water to a washing zone in the glass washing and dishwashing machine.

It is still a further object of the present invention to provided an improved glass washing and dishwashing machine which incorporates a central processing unit (CPU)/controller with supporting electronics that is Internet enabled and can be interfaced with a standard computer/palmtop i.e., Windows/Mac/Unix server etc. This capability provides the machine with advanced visual diagnostics and real time feedback of system status either at the glass washing machine itself by viewing its large integrated backlit touch panel display or, from a remote location using a computing device. This makes preventative maintenance of the system more efficient and its overall maintainability user friendly. The CPU and its supporting electronics provide for overall more efficient use of water, consumables, energy, and operation of moving parts. It allows for constant monitoring of all motors, wire resistance, flow rates and other mechanical workings that can in fact be monitored electronically allowing for improved performance and reliability.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated:

FIG. 10 is a perspective view of the water tank assembly assembled and the selectively positionable drain mechanism for the washing zone of the glass washing and dishwashing machine;

FIG. 11 is an enlarged transverse cross-sectional view of the water tank assembly shown in FIG. 10, showing the improved tank valve/water diversion mechanism for selectively supplying water from the water and rinse chambers to a pump which in turn supplies water to the oscillating spray mechanism;

DESCRIPTION OF THE PREFERRED EMBODIMENT

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
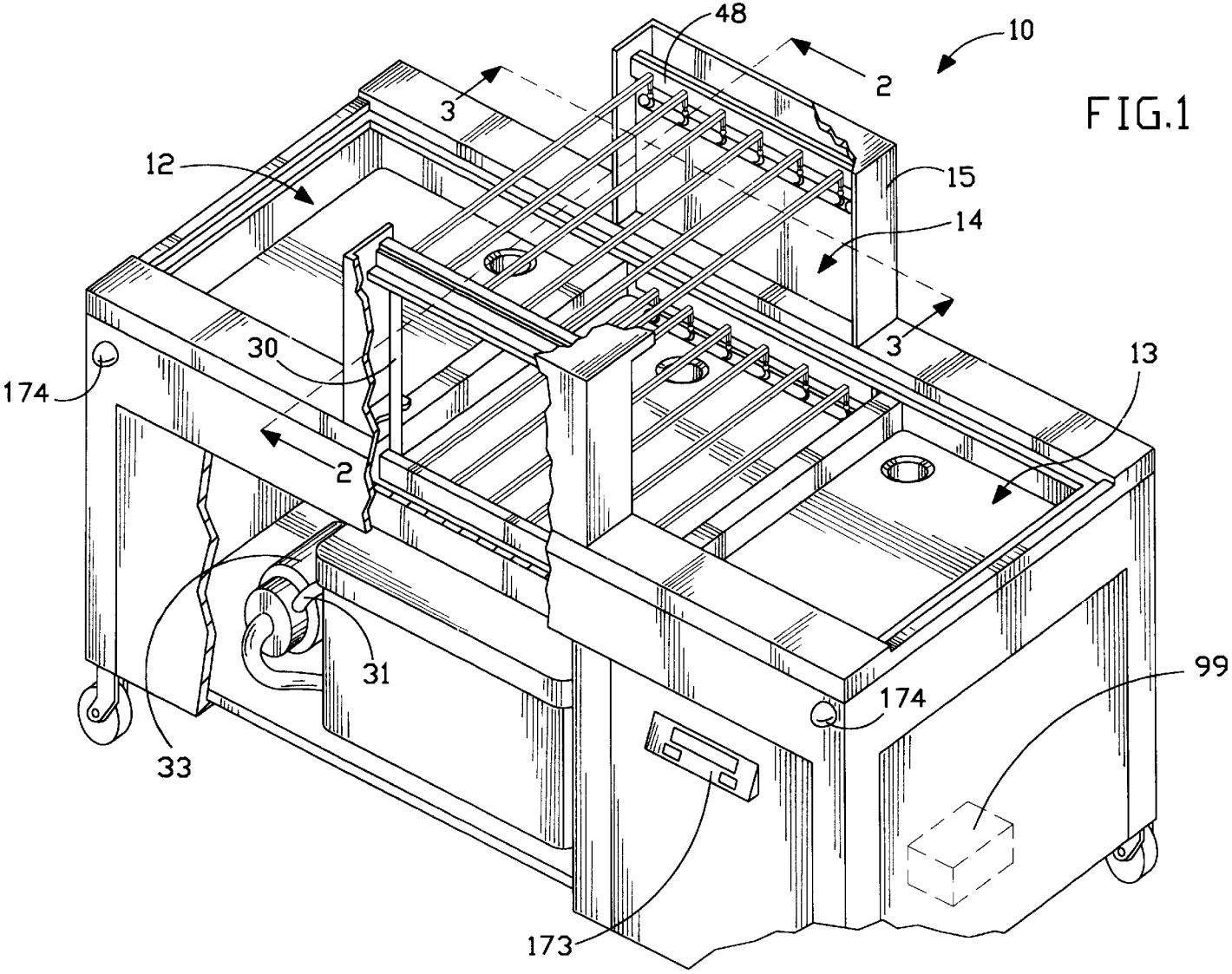
FIG. 1 is an illustration of a glass washing and dishwashing machine of the type with which the present invention is utilized, with certain portions thereof broken away to better illustrate the structural relationship of the components forming a part of the present invention.

Referring to FIG. 1, there is illustrated at 10 an improved glass washing and dishwashing machine which is preferably the type disclosed in the '263 patent, the contents of said patent incorporated by reference herein. The improved glass washing and dishwashing machine 10 generally comprises loading and unloading zones 12 and 13, and a washing zone 14 located between the loading and unloading zones. Either of these loading and unloading zones 12 and 13 can be utilized as a loading and/or unloading zone as described in the '263 patent.

Referring to FIGS. 1 through 12, the present invention glass washing and dishwashing machine 10 comprises an improved oscillating spray mechanism 16, an improved tank valve/water diversion mechanism 18, and an improved water tank assembly 68, which arc all incorporated into the glass washing and dishwashing machine 10.

Figure 2:
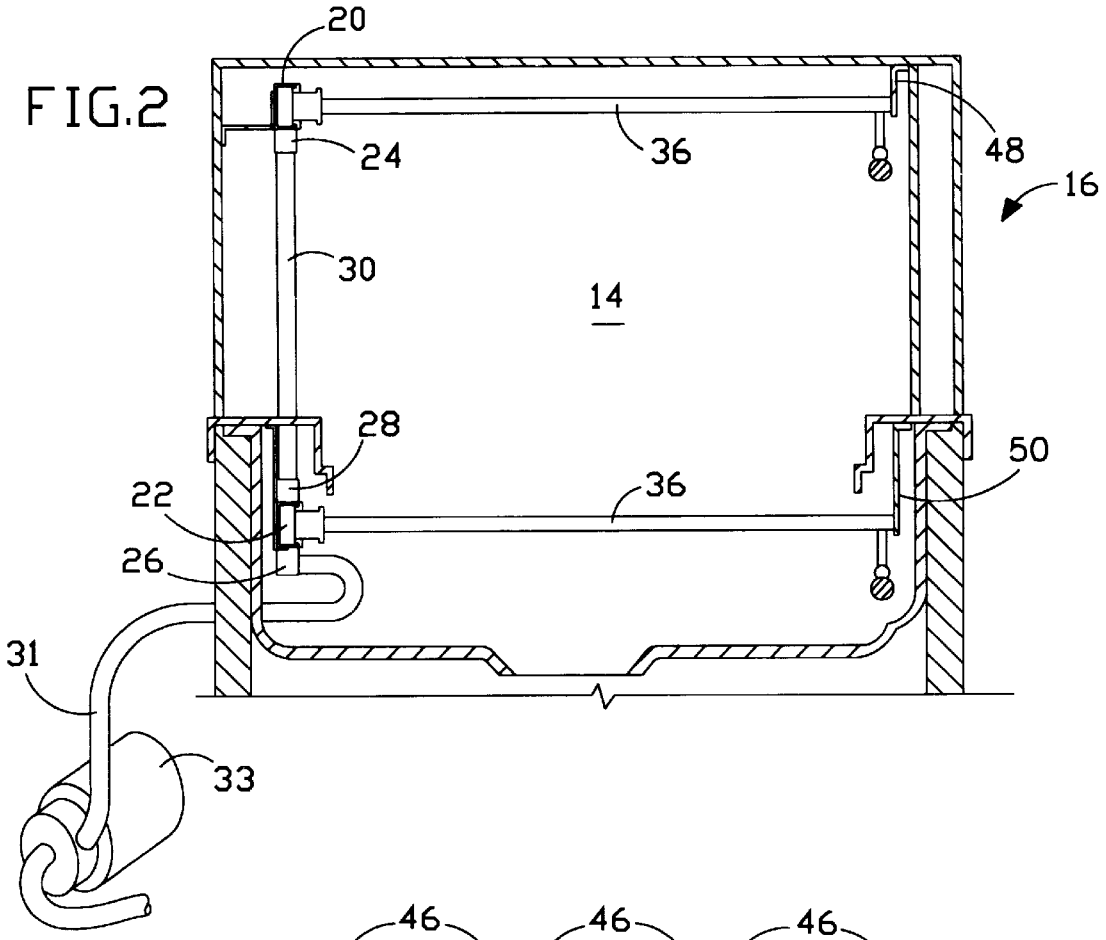
FIG. 2 is a partial cross-sectional view of a preferred embodiment of an improved oscillating spray mechanism, which is taken along line 2—2 of FIG. 1.
Figure 3:
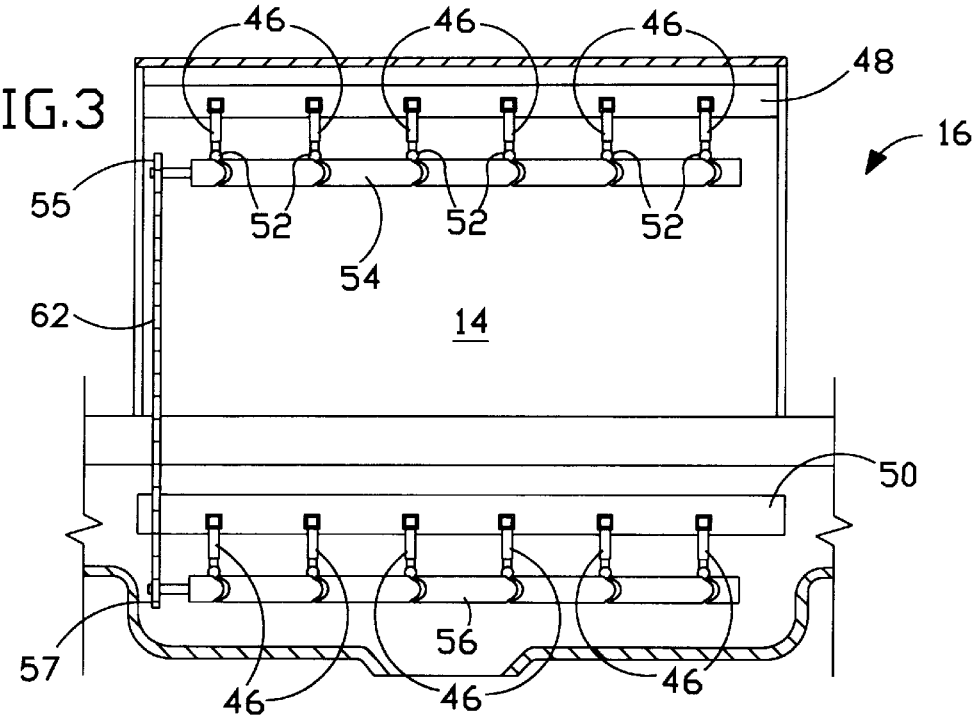
FIG. 3 is a partial cross-sectional view of the improved oscillating spray mechanism shown in FIG. 2, which is taken along line 3—3 of FIG. 1.

Referring to FIGS. 1, 2 and 3, the improved oscillating spray mechanism 16 comprises a generally elongated hollow front upper manifold 20, a generally elongated hollow front lower manifold 22 which is located parallel to and below the upper manifold 20, and a plurality of elongated rectangular shaped hollow spray bars 36; preferably six upper spray bars and six lower spray bars located parallel to the upper spray bars. The upper and lower manifolds 20 and 22 are mounted within an upper housing 15 which houses the washing zone 14. The upper manifold 20 has an inlet port 24 for supplying water to the upper spray bars. The lower manifold 22 also has an inlet port 26 and an outlet port 28 for supplying water to the upper spray bars. The inlet port 24 of the upper manifold 20 is interconnected to the outlet port 28 of the lower manifold 22 by a flexible conduit or hose 30, so that the two manifolds are in fluid communication with each other. A second flexible conduit or hose 31 is also provided for interconnecting the inlet port 26 of the lower manifold 22 to a wash water and rinse water pump 33 for supplying water thereto.

Figure 4:
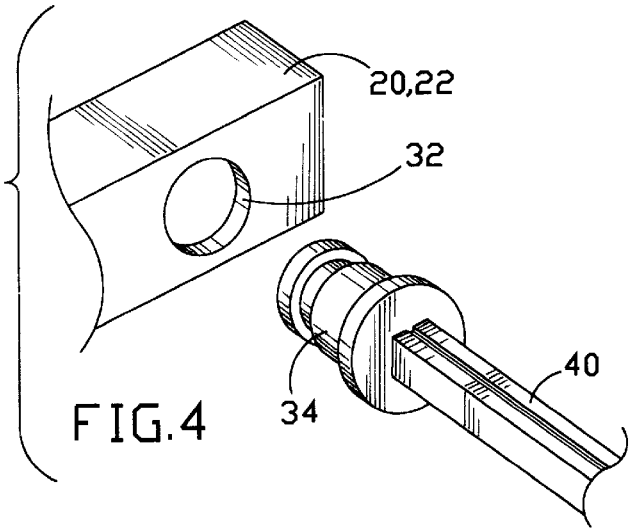
FIG. 4 is a partial enlarged and exploded perspective view of an end of one of the spray bars uninstalled from a manifold to illustrate the removable interconnection feature.

Referring to FIGS. 2 and 4, each of the two manifolds 20 and 22 has an inner face which contains a plurality of spaced apart apertures 32 (only one is shown in FIG. 4) facing the interior of the washing zone 14. The plurality of spaced apart apertures 32 are arranged in a lengthwise direction along the inner faces of the manifolds 20 and 22. Each aperture 32 is adapted to receive an adaptable annular collar 34 which is water sealed therein and is rotatably mounted to the inner faces of the manifolds 20 and 22. Each adaptable annular collar 34 receives an open end of each spray bar 36 for reversible rotation about its longitudinal axis and for translation relative to the longitudinal axis.

Figure 6:
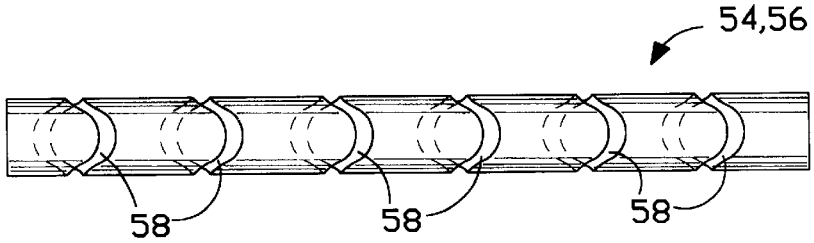
FIG. 6 is an enlarged side elevational view of one of the two driving shafts, showing transverse zig-zag grooves.

Referring to FIGS. 3 and 6, there is illustrated a plurality of spring-loaded arms 46, preferably six upper spring-loaded arms and six lower spring-loaded arms, which are respectively installed on the other closed ends of the spray bars 36, which in turn is pivotably and respectively connected to elongated upper and lower brackets 48 and 50. Each of the upper and lower spring-loaded arms 46 has a free distal ball end 52 which engages with upper and lower driving shafts 54 and 56 (only one is shown in FIG. 6). The spring-loaded arms 46 significantly reduces the stress applied to the mechanism. The upper and lower driving shafts 54 and 56 are identical, and are rotatably mounted within the washing zone 14 and respectively adjacent to the plurality of upper and lower spring-loaded arms 46. Each of the two driving shafts 54, 56 has a plurality of spaced apart transverse zig-zag grooves 58 therein, where the distal ball end 52 of each of the upper and lower spring-loaded arms respectively engages with and travels along each transverse zig-zag groove 58 for oscillating the spray bars 36.

While the upper and lower driving shafts 54 and 56 are rotating, the spring-loaded arms 46 respectively engage and travel along the transverse zig-zag grooves 58 which in turn moves the spray bars 36 in a left and right direction which are reversibly rotated through an arc. In this manner, the water spray issuing from the upper spray bars 36 are oscillated to cover the washing zone from the upper side, while the water spray issuing from the lower spray bars 36 are oscillated and sprayed between the tines provided by the center rack (not shown) to cover the washing zone from the lower side.

Figure 13:
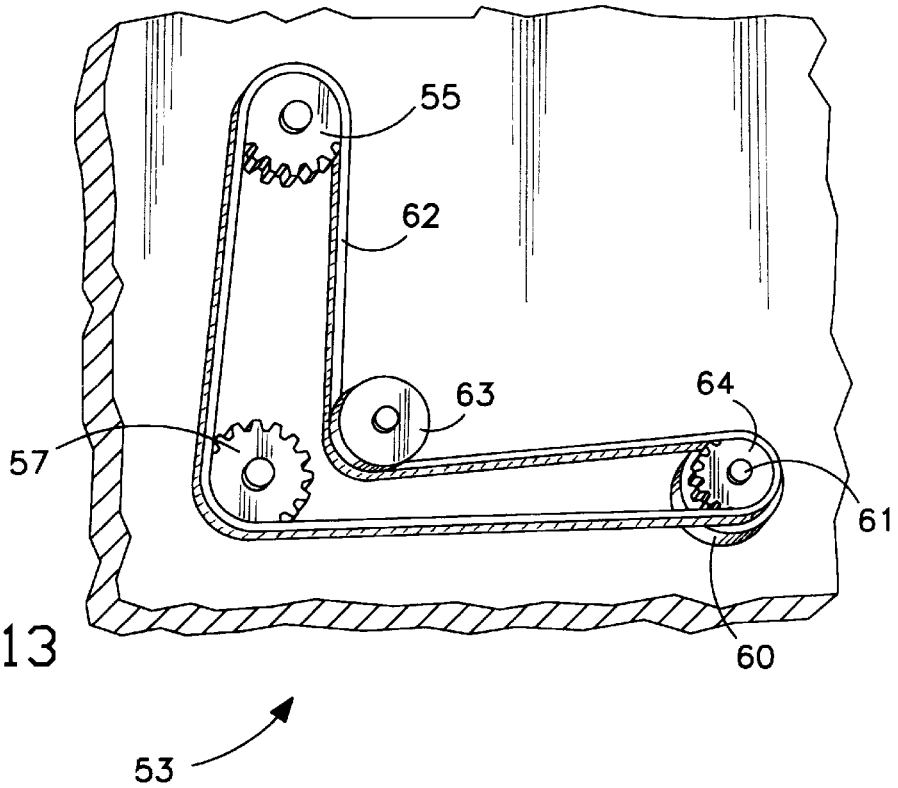
FIG. 13 is an enlarged perspective view of a driving mechanism for rotating the driving shafts which in turn oscillate the spray mechanism.

Referring to FIGS. 3, 6 and 13, there is shown a driving mechanism 53 which comprises an electrical motor 60, an upper cam wheel 55 mounted to one end of the upper driving shaft 54, a lower cam wheel 57 mounted to one end of the lower driving shaft 56, a guide roller 63, and a belt 62. The electrical motor 60 has a driving shaft 61 and a cam wheel 64 which is rotatably mounted to the driving shaft 61. The belt 62 couples the upper cam wheel 55, the lower cam wheel 57 and the cam wheel 64 while the guide roller 63 guides the belt 62 to the driving cam wheel 64. The electrical motor 60 rotates the driving shaft 61 which in turn rotates the cam wheel 64 which in turn rotates the belt 62 to rotate the cam wheels 55 and 57 to rotate the driving shaft 54 and 56, which in turn allows the distal ball end 52 of each of the spring-loaded arms 46 to move along each of the transverse zig-zag grooves 58 to oscillate the upper and lower spray bars 36, whereby the upper and lower spray bars 36 oscillate to spray water into the washing zone for cleaning glasses and dishes therein.

Figure 5:
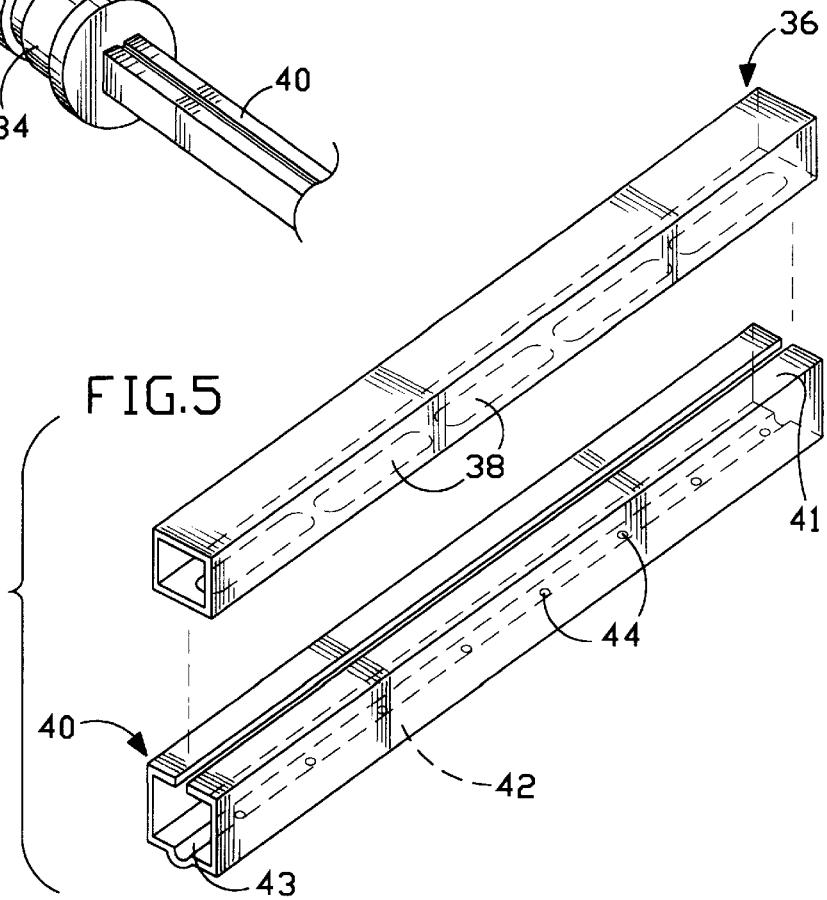
FIG. 5 is an enlarged and exploded perspective view of a cover member uninstalled from one of the spray bars.

Referring to FIG. 5, each spray bar 36 has a plurality of spaced apart rectangular shaped bores 38 with rounded corners for allowing water to spray out and into the washing zone 14. The rectangular shaped bores 38 of the upper spray bars are oriented to spray in a downward direction into the interior of the washing zone 14 while the rectangular shaped bores 38 of the lower spray bars are oriented to spray in an upward direction into the interior of the washing zone 14. A plurality of elongated snap-on cover members 40 are provided with the spray mechanism 16. Each snap-on cover member 40 has a longitudinal split top wall 41, a bottom wall 42, a longitudinal arcuate channel 43 located centrally and longitudinally on the bottom wall 42, and a plurality of spaced apart small bores 44 located on the arcuate channel 43. Each snap-on cover member 40 is respectively installed over each spray bar 36 such that the small bores 44 on the cover member 40 are aligned with the rectangular shaped bores 38 of the spray bar 36. The snap-on cover member 40 may be provided with different hole sizes and shapes and can easily be attached or detached to the spray bar. This design allows for quick change over in order to provide different spray patterns to clean various objects ranging from test tubes to dishes/plates to auto-parts etc. What is unique about the cover members 40 is that they are installed by simply snapping onto the spray bar and can easily be replaced with a different type of cover member having larger bores therein to decrease the pressure of the water spraying out and into the washing zone. The rectangular shaped bores 38 are spaced to provided optimum throughput of water to be delivered through the snap-on cover members 40. It is the snap-on cover members 40 that determines the spray pattern and pressure applied to the objects being washed.

Figure 7:
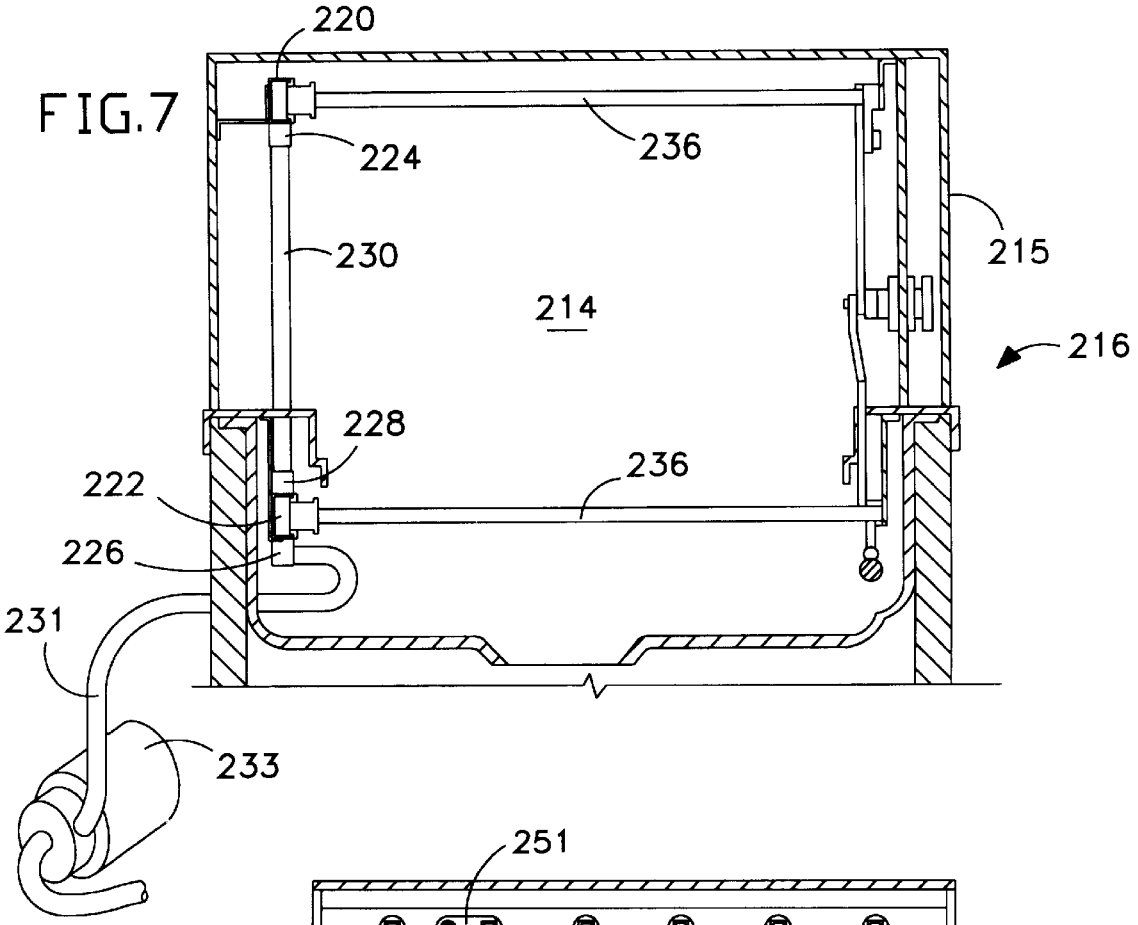
FIG. 7 is a partial cross-sectional view of an alternative embodiment of the improved oscillating spray mechanism.
Figure 8:
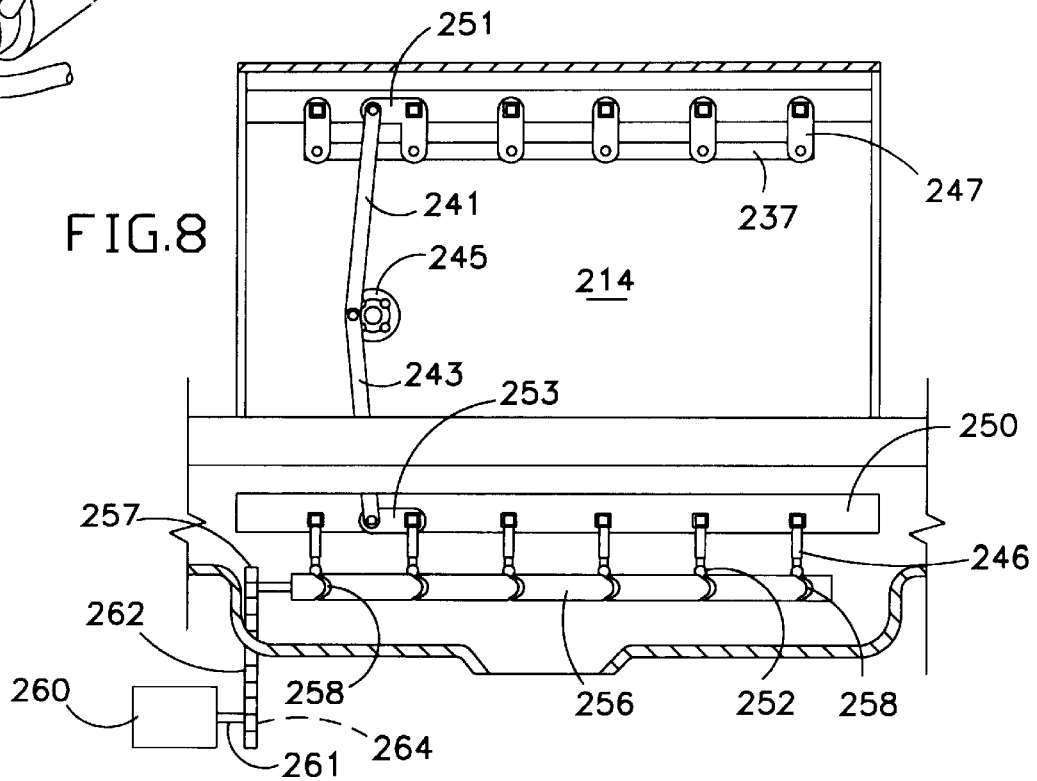
FIG. 8 is a partial cross-sectional view of the improved oscillating spray mechanism shown in FIG. 7.

Referring to FIGS. 7 and 8, there is shown an alternative embodiment of an improved spray mechanism 216 which comprises a generally elongated hollow front upper manifold 220, a generally elongated hollow front lower manifold 222 which is located parallel to and below the upper manifold 220, and a plurality of elongated hollow spray bars 236; preferably six upper spray bars and six lower spray bars. The upper and lower manifolds 220 and 222 are mounted within an upper housing 215 which houses the washing zone 214. The upper manifold 220 has an inlet port 224 for supplying water to the upper spray bars. The lower manifold 222 also has an inlet port 226 and an outlet port 228 for supplying water to the upper spray bars. The inlet port 224 of the upper manifold 220 is interconnected to the outlet port 228 of the upper manifold 222 by a flexible conduit or hose 230, so that the two manifolds are in fluid communication with each other. A second flexible conduit or hose 231 is also provided for interconnecting the inlet port 226 of the lower manifold 222 to a wash and rinse water pump 233 for supplying water thereto.

The upper manifold 220 carries six upper spray bars 236 which are reversibly rotated through an arc to cause the rectangular shaped bores (not shown but comparable to bores 38 shown in FIG. 5) to oscillate to fully cover the entire washing zone 214. Downwardly extending arms 247 are affixed to each of the upper spray bars 236. These arms are connected by pivot pins to a single horizontal connecting link 237. As this link 237 reciprocates in a left and right direction, the upper spray bars 236 are reversibly rotated through an arc of generally 30° to 60°. The water spray issuing from the bores of the upper spray bars 236 is oscillated to cover the entire washing region from the upper side. The lower manifold 222 also carries six lower spray bars 236 for reversible rotation and longitudinal translation. The lower spray bars 236 also have bores (not shown but spray issuing therefrom in a generally upward direction across the washing zone and between the tines on the center rack (not shown).

Two vertical linkage arms 241 and 243 are interconnected to a central location 245. The first linkage arm 241 is connected to one end of an L-shaped arm 251 which in turn is connected to one of the upper spray bars 236 and the horizontal linkage 237. The second linkage arm 243 is connected to a linkage arm 253 which is connected to one of the lower spray bars 236.

A plurality of spring-loaded arms 246, preferably six, are respectively installed on the other closed ends of the lower spray bars 236, which in turn is pivotably connected to an elongated lower bracket 250. Each of the spring-loaded arms 246 has a free distal ball end 252 which engages with a lower driving shaft 256. The lower driving shaft 256 is rotatably mounted within the washing zone 214 and adjacent to the plurality of lower spring-loaded arms 246. The driving shaft 256 has a plurality of spaced apart transverse zig-zag grooves 258 therein, where the distal ball end 252 of each of the lower spring-loaded arms 246 respectively engages with and travels along each transverse zig-zag groove 258 for oscillating the lower spray bars 236 which in turn moves the linkage arm 253, which in turn moves the two vertical linkage arms 241 and 243 which in turn rocks the L-shaped arm 251, which in turn oscillates the horizontal linkage 237 to move the upper spray bars 236 which are reversibly rotated through an arc.

While the lower driving shaft 256 is rotating, the spring-loaded arms 246 respectively engage and travel along the transverse zig-zag grooves 258 to move the spray bars 236 in a left and right direction which are reversibly rotated through an arc.

Referring to FIG. 8, the lower driving shaft 256 is rotated by a driving mechanism which comprises an electrical motor 260, a cam wheel 257 mounted to one end of the lower driving shaft 256 and a belt 262. The electrical motor 260 has a driving shaft 261 and a cam wheel 264 which is rotatably mounted to the driving shaft 261. The belt 262 couples the cam wheels 257 and 264. The electrical motor 260 rotates the driving shaft 261 which in turn rotates the cam wheel 264 which in turn rotates the belt 262 to rotate the cam wheel 257 to rotate the lower driving shaft 256, which in turn allows the distal ball end 252 of each of the spring-loaded arms 246 to move along each of the transverse zig-zag groove 258 to oscillate the spray bars 236 for cleaning glasses and dishes therein.

Figure 9:
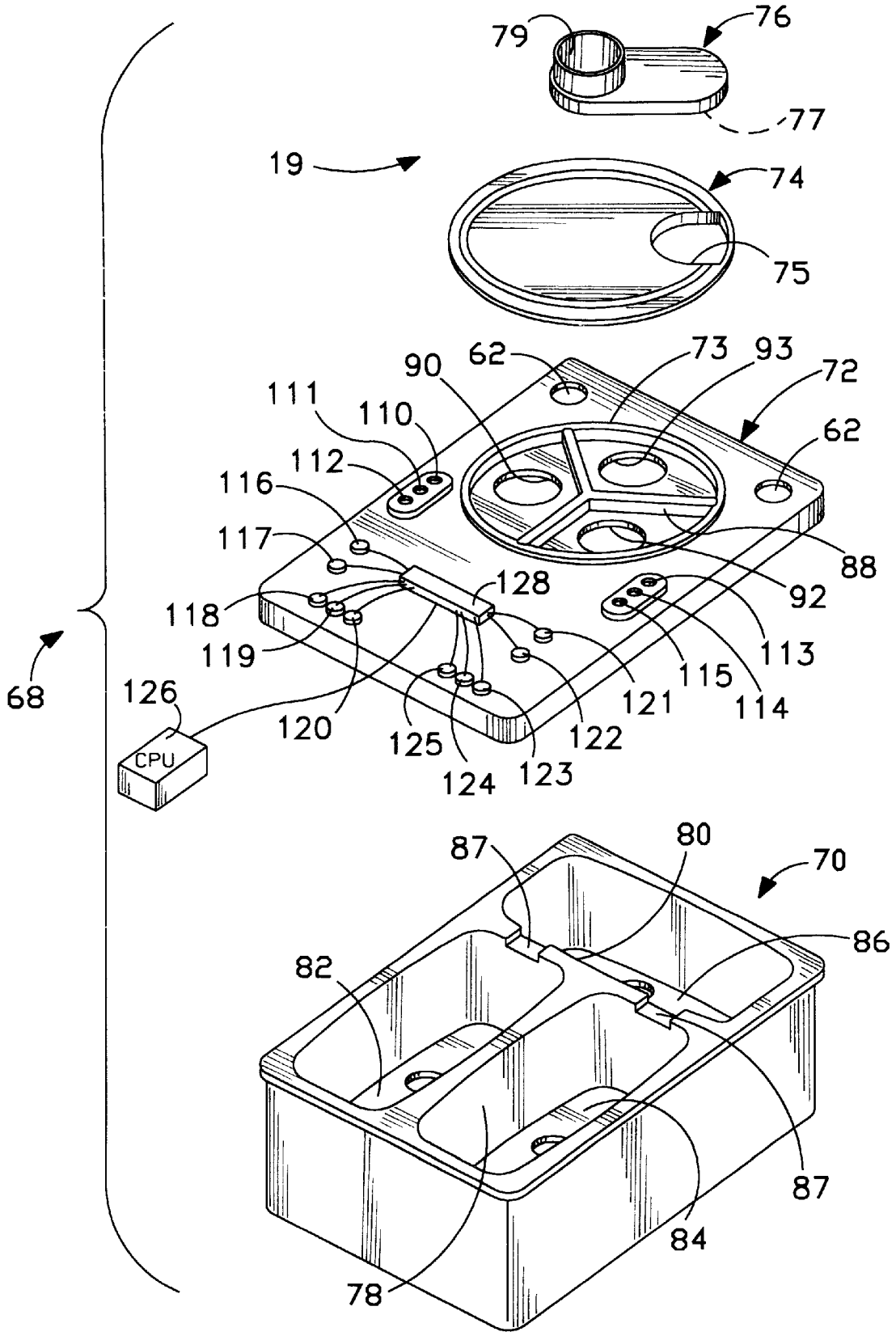
FIG. 9 is an exploded perspective view of an improved water tank assembly of the present invention.

Referring to FIGS. 9, 10 and 11, there is shown at 68 the water tank assembly which comprises an improved water tank 70, a main sealed lid 72, and the sink water diverter lid 19 including a rotatable splash guard 74 and a rotatable sink water diverter 76.

The water tank 70 is generally of a rectangular construction and is divided into three separate chambers by two integral partitions 78 and 80 to form a left wash water reservoir chamber 82, a right rinse water reservoir chamber 84, and a rear drain chamber 86. The first partition 78 runs longitudinally and approximately ¾ of the length of the water tank 70 from the front wall towards the rear wall and is centrally located between the sidewalls of the water tank 70. The rear end of the first partition 78 is integrally formed to the forward side of the second partition 80 which lies perpendicular to the first partition 78. The second partition 80 has two overflow prevention channels 87 for preventing overflow from the wash and rinse chambers 82 and 84. The rear chamber 86 is connected to a drain conduit (not shown) which in turn is connected to a sewage drain which sewers the water from the pre-wash cycle and pre-rinse cycle. Each chamber has interior rounded radius corners for easy cleaning and the prevention of residue build-up.

Referring to FIG. 9, the main sealed lid 72 is installed over and covers the entire top of the water tank 70 to prevent water from splashing out from the water tank 70. The main sealed lid 72 has a circular shaped raised rim 73 and an Y-shaped raised ridge 88 which is integrally formed on top of the main sealed lid 72 and located within the circular shaped central rim 73, where the Y-shaped raised ridge 88 separates three openings 90, 92, and 93 provided on top of the main sealed lid 72, so that the returning water from the washing zone 14 can be diverted into one of these three chambers 82, 84 and 86 of the water tank 70. Two small apertures 62 are provided with the main sealed lid 72 for left and right drain pipes 101 and 102 from the left and right sinks of the loading and unloading zones (see FIG. 1) to enter into the drain chamber 86. The main sealed lid 72 also includes a hot water inlet 110, a cold water inlet 111, and a detergent inlet 112 which are located at one side of the lid 72 and above the wash chamber 82. In addition, a hot water inlet 113, a cold water inlet 114, and a sanitize and rinse agent inlet 115 are also provided and located on the other side of the lid 72 and above the rinse chamber 84. The hot water inlets 110 and 113 are connected by hoses (see FIG. 10) which are then connected to a main hot water supply (not shown). The cold water inlets 111 and 114 are connected by hoses (see FIG. 10) which are then connected to a main cold water supply (not shown). The detergent inlet 112 is also connected by a hose (see FIG. 10) which is then connected to a detergent supply (not shown). The sanitize and rinse agent inlet 115 is also connected by a hose (see FIG. 10) which is then connected to a sanitize and rinse agent supply (not shown). All of the supplies are injected from above and into their respective chamber.

Referring to FIGS. 9 and 11, a heater 116, a detergent level sensor 117, a water level sensor 118, a wash purge sensor 119, and a temperature sensor 120 are all mounted on the main sealed lid 72 and extend into the wash chamber 82. A second heater 121, a sanitize and rinse agent level sensor 122, a second water level sensor 123, a rinse purge sensor 124, and a second temperature sensor 125 are all mounted on the main sealed lid 72 and extend into the rinse chamber 84. These sensors are used for sensing the different conditions in the glass washing and dishwashing machine 10. The heaters and the sensors are conventionally connected to a terminal junction box 128 which in turn is connected and controlled by a central processing unit (CPU) 126.

Referring again to FIGS. 9, 10 and 11, the sink water diverter lid 19 comprises a rotatable splash guard 74 and a rotatable sink water diverter 76. The rotatable splash guard 74 is rotatably installed over the circular shaped central rim 73 of the main sealed lid 72. The splash guard 74 has also an open lip 75 which can be rotated to selectively be aligned with and in fluid communication with one of the wash opening 90, the rinse opening 92 or the drain opening 93 on the main lid 72. The rotatable sink water diverter 76 has an inlet port 79 and an outlet port 77, where the outlet port 77 is installed and secured to the open lip 75 of the splash guard 74, so that the inlet port 79 is in fluid communication with the open lip 75 of the splash guard 74. The main sealed lid 72 and the sink water diverter lid 19 significantly reduce heat loss in water temperature both in the transfer of water from the main washing zone into the wash and rinse chambers 82, 84 as well as containing heat within the water tank 70 reducing evaporation, splashing and condensation due to being capped off.

Any wash and rinse water escaping from the washing zone 14 and into the side sinks underlying the right and left loading and unloading zones and any residual water on glasses after being washed and transferred to the unloading zone are drained back to the drain chamber 86 through the respective left and right drain pipes 101 and 102. The water from the sink underlying the washing zone drains into the drain chamber 86 via a fixed conduit 104 which is coupled to the inlet port 79 of the rotatable sink water diverter 76. The longitudinal axis of the fixed conduit 104 is vertically oriented and substantially coincides with the intersection of the central partition 78 and rearward partition 80 in thc water tank 70. A belt 106 is wrapped around the inlet port 79 of the rotatable sink water diverter 76 and a cam wheel 108. The cam wheel 108 is connected to an output shaft 109 which is coupled to an electric reversible DC motor 107. The outlet port 77 of the rotatable sink water diverter 76 can be selectively positioned to overlie the wash water reservoir chamber 82, the rinse water reservoir chamber 84 or the drain water chamber 86 by the belt 106 and can thus selectively return water from the washing zone 14 to the wash reservoir chamber 82 or the rinse water reservoir chamber 84.

Figure 12:
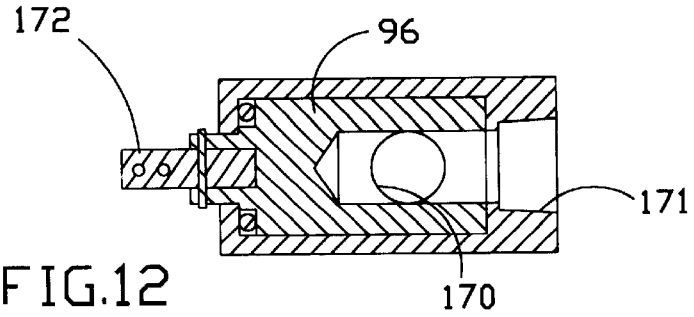
FIG. 12 is a cross-sectional view taken along line 12—12 of FIG. 11.

Referring to FIGS. 10, 11 and 12, two conduits 92 and 93 are conventionally connected to drain openings at the bottom of the wash water and rinse water reservoir chambers 82 and 84. These conduits 92 and 93 are in turn connected to the tank valve/water diversion mechanism 18 which is controlled by a rotary valve diverter 96. The tank valve/water diversion mechanism 18 has a structure 94 with an elongated channel 95 running in the lengthwise direction. The rotary valve diverter 96 is centrally located within the structure 94 and separates the channel 95 into a wash channel 97 and a rinse channel 98. The rotary valve diverter 96 is controlled by the CPU 126 and its supporting circuitry (not shown). The rotary valve diverter 96 has a side inlet connection 170 and a rear outlet connection 171, where the side inlet connection can be rotated in fluid communication with either the wash channel 97 or the rinse channel 98, which in turn places one or the other of the conduits 92 and 93 in fluid communication with the rear outlet connection 171. The rear outlet connection 171 of the rotary valve diverter 96 is connected to a supply conduit 100 which is connected to the pump 33. The pump 33 supplies water to the upper and lower manifolds 20 and 22 of the oscillating spray mechanism 16. The pump 33 can supply either wash water or rinse water upon demand, depending on the position of the rotary valve diverter 96. One of the unique features of the tank valve/water diversion mechanism 18 is that it prevents migration from one chamber to the other.

Referring to FIGS. 1 and 12, an electric motor 99 is coupled to a front driving end 172 of the rotary valve diverter 96 for rotating the rotary valve diverter 96 so that the side inlet connection 170 is in fluid communication with either the wash or rinse channels of the structure 94 of the tank valve/water diversion mechanism 18.

Referring to FIG. 1, the present invention glass washing and dishwashing machine 10 is provided with a control panel and display 173 which is located on the front of the machine 10. In addition, there are four start switches 174 which are used to start the wash cycle. The switches 174 have indicator lights that flash depending on the mode of operation. The two switches that are on the same side of the machine 10 are functionally redundant. The switch is pressed on the side of the machine 10 containing a loading/unloading rack to be moved into the washing zone 14.

In operation, glasses to be washed are placed on one of the left or right transport racks. The term glasses is used herein as a matter of convenience. It is intended that when the term glasses or dishes is used that it includes all glasses, dishware and silverware. For purposes of this operational description, glasses are loaded onto the right transport rack and are unloaded from the left transport rack. However, it is to be understood that the transport racks can be operated in any desired sequence, as described above, to load or unload glasses from either loading and unloading zone. In addition, conventional dish holding baskets can be placed on the racks and transported into and out of the washing zone 14 in the same manner as glasses placed directly on the racks.

After manually loading glasses on the right rack, the glasses are transported to the washing zone 14. The washing sequence is initiated by pressing one of the switches 174. The washing machine 10 may include four phases in a wash cycle including a pre-wash cycle, a wash cycle, a pre-rinse cycle, and a rinse cycle. The CPU automatically controls all functions of the washing machine 10 and places all components in the correct positions.

During the pre-wash cycle, the glasses are initially wash by the oscillating spray mechanism 16 to remove large particles from the glasses. The rotatable sink water diverter 76 is rotatably positioned into the drain chamber 86 as shown in FIG. 10. The rotary valve diverter 96 is then activated to rotate its side inlet opening 170 in fluid communication with the wash channel 97. Wash water from the wash reservoir chamber 82 is thus supplied by the pump 33 to the oscillating spray mechanism 16 in the washing zone 14. The wash water is then discharged down the drain and into the drain chamber 86 which drains into the sewage. No recycling of water occurs during the pre-wash cycle. The duration of the pre-wash cycle is approximately fifteen (15) seconds and uses approximately 0.75 gallon of water.

During the wash cycle, the rotatable sink water diverter 76 is rotatably positioned in fluid communication with the wash reservoir chamber 82. The side inlet opening 170 of the rotary valve diverter 96 will still be in fluid communication with the wash channel 97 because of the pre-wash cycle. Wash water from the wash reservoir chamber 82 is thus supplied by the pump 33 to the oscillating spray mechanism 16 in the washing zone 14, where the wash water is then drained back into the wash reservoir chamber 82 to be recycled or reused. The duration of the wash cycle is approximately forty-five (45) seconds and uses approximately zero gallon of water because it is recycled.

During the pre-rinse cycle, detergent water from the wash cycle is wash away. The rotatable sink water diverter 76 is rotatably positioned in fluid communication with the drain chamber 86. The rotary valve diverter 96 is activated to rotate its side inlet opening 170 in fluid communication with the rinse channel 98. Rinse water from the rinse reservoir chamber 84 is thus supplied by the pump 33 to the oscillating spray mechanism 16 in the washing zone 14, where the rinse water is then discharged down the drain and into the drain chamber 86 which drains into the sewage. No recycling of water occurs during the pre-rinse cycle. The duration of the pre-rinse cycle is approximately fifteen (15) seconds and uses approximately 0.75 gallon of water.

During the rinse cycle, the rotatable sink water diverter 76 is rotatably positioned in fluid communication with the rinse reservoir chamber 84. The side inlet opening 170 of the rotary valve diverter 96 will still be in fluid communication with the rinse channel 98. Rinse water from the rinse reservoir chamber 84 is thus supplied by the pump 33 to the oscillating spray mechanism 16 in the washing zone 14, where the rinse water is then drained back into the rinse reservoir chamber 84 to be recycled or reused. The duration of the rinse cycle is approximately forty-five (45) seconds and uses approximately zero gallon of water because it is recycled.

When all four cycles or when a rinse cycle are completed, the rotary valve diverter 96 will be activated to rotate to the off position, where its side opening 170 faces upwardly thereto for the next cycle to begin.

Figure 14:
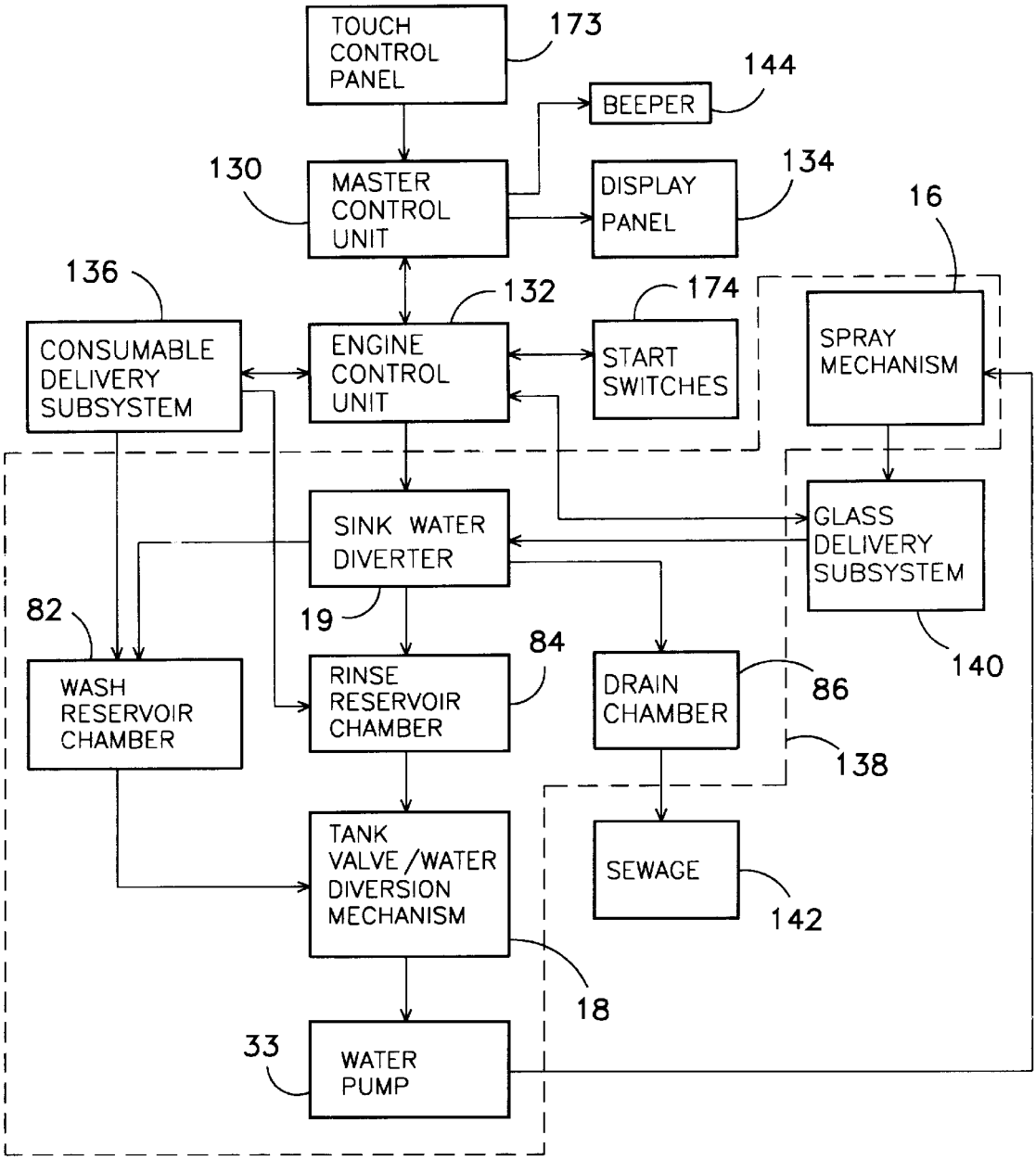
FIG. 14 is a functional block diagram of the present invention glass washing and dishing washing machine.

Referring to FIG. 14, there is shown a functional block diagram of the present invention glass washing and dishwashing machine. The glass washing and dishwashing machine utilizes a dual central processing units located in a master control unit (MCU) 130 and an engine control unit (ECU) 132. An operator control panel 173 is coupled to the MCU 130 which in turn couples to the ECU 132. The MCU 130 interfaces with the operator control panel 173 and communicates to the ECU 132 over a serial interface. The control panel 173 selects operation modes and values of the glass washing and dishwashing machine, where the MCU 130 processes the selection and values, and displays them on a display panel 134 and interfaces with the ECU 132. A beeper device 144 is coupled to the MCU 130 and used for operator alerts. The ECU 132 interfaces and monitors all motors and sensors in a consumable delivery subsystem 136, a water delivery subsystem 138, and a glass delivery subsystem 140. Start switches 174 are coupled to the ECU 132 and are used to start wash cycles. The water delivery subsystem 138 includes a spray mechanism 16, a wash water reservoir chamber 82, a rinse water reservoir chamber 84, a drain water chamber 86, and a pump 33. The consumable delivery subsystem 136 delivers detergent, sanitizer, and rinse agent to the wash reservoir chamber 82 and the rinse reservoir chamber 84, where the consumable delivery subsystem 136 can be replenished when notified by the ECU 132. The ECU 132 is further coupled to a sink water diverter 19 which controls whether the sink output water is diverted to the wash chamber 82, the rinse chamber 84 or the drain chamber 86. The drain chamber 86 is connected to a sewage for disposal of water and particles. A tank valve/water diversion mechanism 18 is coupled to the wash chamber 82 and the rinse chamber 84, where the diversion mechanism 18 controls whether the water to a pump 33 comes from the wash reservoir chamber 82 or the rinse reservoir chamber 84. The pump 33 is used to deliver water and solutions to a spray mechanism 16. The glass delivery system 140 may include at least two input/output racks, at least two curtains and at least one center rack. The glass delivery subsystem 140 may further include at least one input/output rack, at least one curtain, and no center rack. The glass delivery system 140 lowers both curtains and raises the center rack. Conversely, the center rack is lowered when the curtains are raised. There are separate signals from the ECU 132 for curtain on/off control and curtains direction (up/down).

Defined in detail, the present invention is a spray mechanism for use in conjunction with a glass washing and dishwashing machine having a washing zone, the spray mechanism comprising: (a) an elongated hollow lower manifold mounted within and below the washing zone and having an inlet port and an outlet port; (b) an elongated lower bracket mounted within and below the washing zone and located opposite to the lower manifold; (c) a plurality of spaced apart hollow lower spray bars, each having a closed end, an open end rotatably connected to the lower manifold for allowing water to flow therethrough, and a plurality of spaced apart small bores for allowing water to spray out into the washing zone; (d) a plurality of lower spring-loaded arms, each having a distal ball end, and a proximal end pivotably connected to the lower bracket and located adjacent to the closed end of the each lower spray bar; (e) a lower driving shaft rotatably mounted within the washing zone and adjacent to the plurality of lower spring-loaded arms, the lower driving shaft having a plurality of spaced apart transverse zig-zag grooves therein, where the distal ball end of the each lower spring-loaded arm respectively engages with and travels along the each transverse zig-zag groove for oscillating the each lower spray bar; (f) an elongated hollow upper manifold mounted within and above the washing zone and located parallel to and above the lower manifold, the upper manifold having an inlet port connected to the outlet port of the lower manifold by a first flexible conduit for supplying water thereto; (g) an elongated upper bracket mounted within and above the washing zone and located opposite to the upper manifold; (h) a plurality of spaced apart hollow upper spray bars, each having a closed end, an open end rotatably connected to the upper manifold for allowing water to flow therethrough, and a plurality of spaced apart small bores for allowing water to spray out into the washing zone; (i) a plurality of upper spring-loaded arms, each having a distal ball end, and a proximal end pivotably connected to the upper bracket and located adjacent to the closed end of the each upper spray bar; (j) an upper driving shaft rotatably mounted within the washing zone and adjacent to the plurality of upper spring-loaded arms, the upper driving shaft having a plurality of spaced apart transverse zig-zag grooves therein, where the distal ball end of the each upper spring-loaded arm respectively engages with and travels along the each transverse zig-zag groove for oscillating the each upper spray bar; (k) an elongated cover member respectively installed over the each spray bar and having a channel with a plurality of spaced apart bores which are smaller than and aligned with the plurality of spaced apart bores of the each spray bar; (l) a second flexible conduit connected to the inlet port of the lower manifold for supplying water to the upper and lower spray bars; and (m) means for rotating the upper and lower driving shafts which in turn allow the distal ball end of the each spring-loaded arm to move along the each transverse zig-zag groove to oscillate the plurality of upper and lower spray bars; (n) whereby the upper and lower spray bars oscillate to spray water into the washing zone for cleaning glasses and dishes therein.

Defined broadly, the present invention is a spray mechanism for use in conjunction with a glass washing and dishwashing machine having a washing zone, the spray mechanism comprising: (a) a lower manifold mounted within and below the washing zone and an upper manifold mounted within and above the washing zone and located parallel to and above the lower manifold; (b) a lower mounting bracket mounted within the washing zone and located opposite to the lower manifold; (c) an upper mounting bracket mounted within the washing zone and located opposite to the upper manifold; (d) a plurality of lower spray bars, each having a plurality of bores for allowing water to spray out and into the washing zone, and an open end rotatably connected to the lower manifold for allowing water to flow therethrough, and a closed end; (e) a plurality of upper spray bars, each having a plurality of bores for allowing water to spray out and into the washing zone, an open end rotatably connected to the upper manifold for allowing water to flow therethrough, and a closed end; (f) a plurality of lower spring-loaded arms, each having a proximal end pivotably connected to the lower bracket and located adjacent to the closed end of the each lower spray bar and a distal end; (g) a plurality of upper spring-loaded arms, each having a proximal end pivotably connected to the upper bracket and located adjacent to the closed end of the each upper spray bar and a distal end; (h) a lower driving shaft, rotatably mounted within the washing zone and adjacent to the plurality of lower spring-loaded arms, the lower driving shaft have a plurality of spaced apart transverse zig-zag grooves therein, where the distal ball end of the each lower spring loaded arm respectively engages with and travels along the each transverse zig-zag groove for oscillating the each lower spray bar; (i) an upper driving shaft, rotatably mounted within the washing zone and adjacent to the plurality of upper spring-loaded arms, the upper driving shaft having a plurality of spaced apart transverse zig-zag grooves therein, where the distal ball end of the each upper spring loaded arm respectively engages with and travels along the each transverse zig-zag groove for oscillating the each upper spray bar; (j) a cover member respectively installed over the each spray bar and having a channel with a plurality of bores which are aligned with the plurality of bores of the each spray bar; (k) means for rotating the two driving shafts which in turn allow the distal end of the each spring-loaded arm to move along the each zig-zag groove to oscillate the plurality of spray bars; and (l) means for interconnecting the upper and lower manifolds in fluid communication; (m) whereby the plurality of upper and lower spray bars oscillate to spray water into the washing zone for cleaning glasses and dishes therein.

Defined more broadly, the present invention is a spray mechanism for use in conjunction with a glass washing and dishwashing machine having a washing zone, the spray mechanism comprising: (a) a pair of manifolds mounted within the washing zone and located remote from each other, wherein the pair of manifolds are in fluid communication; (b) a pair of brackets mounted within the washing zone and located remote from each other and respectively facing the pair of manifolds; (c) at least one first spray bar rotatably connected at one end to one of the pair of manifolds for allowing water to flow therethrough, and having at least one bore for allowing water to spray out and into the washing zone; (d) at least one second spray bar rotatably connected at one end to the other one of the pair of manifolds for allowing water to flow therethrough, and having at least one bore for allowing water to spray out and into the washing zone; (e) a linkage respectively connected to the other end of each of the at least one first and second spray bars, the linkage having a free end; (f) at least one driving shaft rotatably mounted within the washing zone and having at least one zig-zag groove therein, where the free end of the linkage engages with and travels along the at least one zig-zag groove for oscillating the at least one first and second spray bars; (g) means for interconnecting the at least one first and second spray bars in fluid communication; and (h) means for driving the at least one driving shaft which in turn allows the free end of the linkage to move along the at least one zig-zag groove to oscillate the at least one first and second spray bars; (i) whereby the at least one first and second spray bars oscillate to spray water into the washing zone for cleaning glasses and dishes therein.

Defined alternatively in detail, the present invention is a tank valve mechanism for use in conjunction with a glass washing and dishwashing machine having a wash tank with a drain and a rinse tank with a drain, the valve mechanism comprising: (a) an elongated structure having first and second apertures at longitudinally spaced locations along a top wall thereof, and an inner surface defining an interior channel in fluid communication between the first and second apertures, the first and second apertures used for respectively connecting to the drains of the wash and rinse tanks; (b) a rotary valve diverter installed within the elongated structure and located between the first and second apertures, the rotary valve diverter having an incoming fluid aperture, an outgoing fluid aperture for connecting to a water supply and a driven end, the rotary valve diverter being rotatable within the elongated structure between a first position wherein the incoming fluid aperture is placed in fluid communication with the first aperture of the elongated structure, a second position wherein the incoming fluid aperture is placed in fluid communication with the second aperture of the elongated structure, and a third position wherein the incoming fluid aperture is not in fluid communication with the first and second apertures of the elongated structure; and (c) a motor means coupled to the driven end of the rotary valve diverter for rotating the valve diverter so that the longitudinal aperture is in fluid communication with either the first or second apertures of the elongated structure.

Defined alternatively broadly, the present invention is a tank valve mechanism for use in conjunction with a glass washing and dishwashing machine having a wash tank with a drain and a rinse tank with a drain, the valve mechanism comprising: (a) a structure having first and second apertures at spaced locations along a top wall thereof, and an inner surface defining an interior channel in fluid communication between the first and second apertures, the first and second apertures used for respectively connecting to the drains of the wash and rinse tanks; (b) a valve diverter installed within the structure and located between the first and second apertures, the valve diverter having a longitudinal aperture, a transverse aperture for connecting to a water supply and a driven end, the valve diverter being rotatable within the structure between a first position wherein the longitudinal aperture is placed in fluid communication with the first aperture of the structure, a second position wherein the longitudinal aperture is placed in fluid communication with the second aperture of the structure, and a third position wherein the longitudinal aperture is not in fluid communication with the first and second apertures of the structure; and (c) means for connecting to the driven end of the valve diverter and rotating the valve diverter so that the longitudinal aperture is in fluid communication with either the first or second apertures of the structure.

Defined alternatively more broadly, the present invention is a valve mechanism for use in conjunction with a glass washing and dishwashing machine having a wash tank with a drain and a rinse tank with a drain, the valve mechanism comprising: (a) a structure having an interior channel with a first aperture and a second aperture, the first and second apertures respectively connected to the drains of the wash and rinse tanks; (b) a diverter installed within the structure and located between the first and second apertures, and being rotatable within the structure between a first position which is in fluid communication with the first aperture and a second position which is in fluid communication with the second aperture; and (c) means for rotating the diverter between the first and second positions.

Further defined in detail, the present invention is a tank assembly for use in conjunction with a glass washing and dishwashing machine having a washing zone sink and loading/unloading zone sinks, the tank assembly comprising: (a) a water tank having at least four walls, a transverse partition integrally formed with a respective two of the at least fours walls, and a longitudinal partition integrally formed between a respective one of the other two walls and the transverse partition to form a wash reservoir chamber, a rinse reservoir chamber and a drain chamber, each chamber having a drain outlet; (b) a main sealed lid installed over and coverin the entire top of the water tank and having at least three spaced apart apertures extending therethrough, a circular shaped raised rim surrounding the at least three spaced apart apertures, and an Y-shaped raised ridge integrally form within the raised rim and separating the at least three apertures, so that returning water from the washing zone sink can be diverted into one of the three chambers of the water tank; (c) means for supplying water to the wash reservoir chamber and the rinse reservoir chamber by injecting through the main sealed lid; (d) means for supplying detergent to the wash chamber by injecting through the main sealed lid; (e) means for supplying sanitize and rinse agent to the rinse chamber by injecting through the main sealed lid; (f) means for monitoring the water level, the detergent level, and the sanitize and rinse agent level; (g) means for heating the water in the wash and rinse reservoir chambers; (h) means for draining the loading/unloading zone sinks to the drain chamber through the main sealed lid; (i) a sink water diverter lid including a rotatable splash guard and a rotatable sink water diverter; (j) the rotatable splash guard rotatably installed over the circular shaped raised rim of the main sealed lid and having an open lip which can be rotated to selectively be aligned with and in fluid communication with one of the at least three apertures on the main sealed lid; (k) the rotatable sink water diverter having an inlet port and an outlet port, the inlet port for installing and securing under the washing zone sink, the outlet port installed and secured to the open lip of the splash guard, so that the inlet port is in fluid communication with the open lip of the splash guard, where the outlet port can be selectively positioned to overlie the wash reservoir chamber, the rinse reservoir chamber or the drain chamber and can thus selectively return water from the washing zone sink to the wash reservoir chamber or the rinse reservoir chamber; and (l) means for selectively positioning the rotatable sink water diverter to one of the three chambers of the tank assembly; (m) whereby the tank assembly significantly reduces heat loss in water temperature both in the transfer of water from the washing zone sink into the wash and rinse chambers as well as containing heat within the water tank reducing evaporation, splashing and condensation due to being capped off.

Further defined broadly, the present invention is a tank assembly for use in conjunction with a glass washing and dishwashing machine having a washing zone sink and loading/unloading zone sinks, the tank assembly comprising: (a) a water tank having a wash reservoir chamber, a rinse reservoir chamber and a drain chamber; (b) a lid installed over and covering the entire top of the water tank and having at least three apertures extending therethrough, so that returning water from the washing zone sink can be diverted into one of the three chambers of the water tank; (c) a rotatable splash guard rotatably installed over the at least three apertures of the lid and having an open lip which can be rotated to selectively be aligned with and in fluid communication with one of the at least three apertures on the lid; (d) a rotatable sink water diverter having an inlet port and an outlet port, the inlet port for connecting and securing under the washing zone sink, the outlet port installed and secured to the open lip of the splash guard, so that the inlet port is in fluid communication with the open lip of the splash guard, where the outlet port can be selectively positioned to overlie the wash reservoir chamber, the rinse reservoir chamber or the drain chamber and can thus selectively return water from the washing zone sink to the wash reservoir chamber or the rinse reservoir chamber; and (e) means for selectively positioning the rotatable sink water diverter to one of the three chambers of the tank assembly; (f) whereby the tank assembly significantly reduces heat loss in water temperature both in the transfer of water from the washing zone sink into the wash and rinse chambers as well as containing heat within the water tank reducing evaporation, splashing and condensation due to being capped off.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modifications in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. A tank assembly for use in conjunction with a glass washing and dishwashing machine having a washing zone sink and loading/unloading zone sinks, the tank assembly comprising:

a. a water tank having at least four walls, a transverse partition integrally formed with a respective two of the at least fours walls, and a longitudinal partition integrally formed between a respective one of the other two walls and the transverse partition to form a wash reservoir chamber, a rinse reservoir chamber and a drain chamber, each chamber having a drain outlet;

b. a main sealed lid installed over and covering the entire top of said water tank and having at least three spaced apart apertures extending therethrough, a circular shaped raised rim surrounding the at least three spaced apart apertures, and an Y-shaped raised ridge integrally form within the raised rim and separating the at least three apertures, so that returning water from said washing zone sink can be diverted into one of said three chambers of said water tank;

c. means for supplying water to said wash reservoir chamber and said rinse reservoir chamber by injecting through said main sealed lid;

d. means for supplying detergent to said wash chamber by injecting through said main sealed lid;

e. means for supplying sanitize and rinse agent to said rinse chamber by injecting through said main sealed lid;

f. means for monitoring the water level, the detergent level, and the sanitize and rinse agent level;

g. means for heating the water in said wash and rinse reservoir chambers;

h. means for draining said loading/unloading zone sinks to said drain chamber through said main sealed lid;

i. a sink water diverter lid including a rotatable splash guard and a rotatable sink water diverter;

j. said rotatable splash guard rotatably installed over said circular shaped raised rim of said main sealed lid and having an open lip which can be rotated to selectively be aligned with and in fluid communication with one of said at least three apertures on said main sealed lid;

k. said rotatable sink water diverter having an inlet port and an outlet port, the inlet port for installing and securing under said washing zone sink, the outlet port installed and secured to said open lip of said splash guard, so that the inlet port is in fluid communication with said open lip of said splash guard, where the outlet port can be selectively positioned to overlie said wash reservoir chamber, the rinse reservoir chamber or the drain chamber and can thus selectively return water from said washing zone sink to said wash reservoir chamber or said rinse reservoir chamber; and l. means for selectively positioning said rotatable sink water diverter to one of said three chambers of said tank assembly;

m. whereby said tank assembly significantly reduces heat loss in water temperature both in the transfer of water from said washing zone sink into said wash and rinse chambers as well as containing heat within said water tank reducing evaporation, splashing and condensation due to being capped off.

2. The tank assembly in accordance with claim 1 wherein said means for monitoring the water level, the detergent level, and the sanitize and rinse agent level include sensors which are controlled by a central processing unit.

3. The tank assembly in accordance with claim 2 wherein said heating means includes a heater which is controlled by said central processing unit.

4. The tank assembly in accordance with claim 1 wherein said transverse partition includes at least two overflow prevention channels for preventing overflow from said wash and rinse reservoir chambers.

5. The tank assembly in accordance with claim 1 wherein said each chamber has interior rounded radius comers for easy cleaning and the prevention of residue build-up.

6. The tank assembly in accordance with claim 1 wherein said water supplying means includes bores located on said main sealed lid and connected by hoses which in turn are connected to a main water supply.

7. The tank assembly in accordance with claim 1 wherein said detergent supplying means includes a bore located on said main sealed lid and connected by a hose to a main detergent supply.

8. The tank assembly in accordance with claim 1 wherein said sanitize and rinse agent supplying means includes a bore located on said main sealed lid and connected by a hose to a sanitize and rinse agent supply.

9. The tank assembly in accordance with claim 1 wherein said means for selectively positioning said rotatable sink water diverter to one of said three chambers of said tank assembly includes an electrical motor, a cam wheel coupled to the motor, and a belt wrapped around said inlet port of said rotatable sink water diverter and the cam wheel.

10. A tank assembly for use in conjunction with a glass washing and dishwashing machine having a washing zone sink and loading/unloading zone sinks, the tank assembly comprising:

a. a water tank having a wash reservoir chamber, a rinse reservoir chamber and a drain chamber;

b. a lid installed over and covering the entire top of said water tank and having at least three apertures extending therethrough, so that returning water from said washing zone sink can be diverted into one of said three chambers of said water tank;

c. a rotatable splash guard rotatably installed over said at least three apertures of said lid and having an open lip which can be rotated to selectively be aligned with and in fluid communication with one of said at least three apertures on said lid;

d. a rotatable sink water diverter having an inlet port and an outlet port, the inlet port for connecting and securing under said washing zone sink, the outlet port installed and secured to said open lip of said splash guard, so that the inlet port is in fluid communication with said open lip of said splash guard, where the outlet port can be selectively positioned to overlie said wash reservoir chamber, the rinse reservoir chamber or the drain chamber and can thus selectively return water from said washing zone sink to said wash reservoir chamber or said rinse reservoir chamber; and e. means for selectively positioning said rotatable sink water diverter to one of said three chambers of said tank assembly;

f. whereby said tank assembly significantly reduces heat loss in water temperature both in the transfer of water from said washing zone sink into said wash and rinse chambers as well as containing heat within said water tank reducing evaporation, splashing and condensation due to being capped off.

11. The tank assembly in accordance with claim 10 further comprising water supplying means which includes bores located on said lid and connected by hoses which in turn are connected to a main water supply.

12. The tank assembly in accordance with claim 10 further comprising heating means for heating water in said wash and rinse reservoir chambers.

13. The tank assembly in accordance with claim 10 further comprising detergent supplying means which includes a bore located on said lid and connected by a hose to a main detergent supply.

14. The tank assembly in accordance with claim 10 further comprising sanitize and rinse agent supplying means which includes a bore located on said lid and connected by a hose to a sanitize and rinse agent supply.

15. The tank assembly in accordance with claim 10 further comprising sensor means for monitoring the water level, the detergent level, and the sanitize and rinse agent level include sensors which are controlled by a central processing unit.

16. The tank assembly in accordance with claim 10 wherein said means for selectively positioning said rotatable sink water diverter to one of said three chambers of said tank assembly includes an electrical motor, a cam wheel coupled to the motor, and a belt wrapped around said inlet port of said rotatable sink water diverter and the cam wheel.

* * * * *